US007533647B2

(12) United States Patent
Miyamoto et al.

(10) Patent No.: US 7,533,647 B2
(45) Date of Patent: May 19, 2009

(54) CYLINDER LINER, CYLINDER BLOCK, AND METHOD FOR MANUFACTURING CYLINDER LINER

(75) Inventors: Noritaka Miyamoto, Toyota (JP); Masaki Hirano, Toyota (JP); Toshihiro Takami, Toyota (JP); Kouhei Shibata, Toyota (JP); Nobuyuki Yamashita, Shiojiri (JP); Toshihiro Mihara, Matsumoto (JP); Giichiro Saito, Yamagata (JP); Masami Horigome, Yamagata (JP); Takashi Sato, Yamagata (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 11/480,995

(22) Filed: Jul. 6, 2006

(65) Prior Publication Data

US 2007/0012177 A1 Jan. 18, 2007

(30) Foreign Application Priority Data

Jul. 8, 2005 (JP) ..... 2005-201001

(51) Int. Cl.
*F02F 1/00* (2006.01)
*B22D 19/00* (2006.01)

(52) U.S. Cl. ..... 123/193.2

(58) Field of Classification Search ..... 123/193.2, 123/193.3; 29/888.061
See application file for complete search history.

(56) References Cited

U.S. PATENT DOCUMENTS 5,749,331 A * 5/1998 Pettersson et al. ..... 123/193.2
7,171,935 B2 * 2/2007 Komai et al. ..... 123/193.2
2003/0056645 A1 3/2003 Land et al.
2003/0084567 A1 5/2003 Dickmann et al.
2005/0005891 A1 * 1/2005 Oh ..... 123/193.2
2005/0161014 A1 * 7/2005 Komai et al. ..... 123/193.2
2007/0012179 A1 * 1/2007 Takami et al. ..... 92/171.1
2007/0012180 A1 * 1/2007 Miyamoto et al. ..... 92/171.1
2007/0240652 A1 * 10/2007 Michioka et al. ..... 123/41.84

FOREIGN PATENT DOCUMENTS

DE 101 50 999 A1 4/2003

(Continued)

OTHER PUBLICATIONS

International Search Report, PCT/JP2006/313920 dated Nov. 6, 2006.
Written Opinion of the International Searching Authority, PCT/JP2006/313920.
International Preliminary Report on Patentability, PCT/JP2006/313920.

*Primary Examiner*—M. McMahon
(74) *Attorney, Agent, or Firm*—Kenyon & Kenyon LLP

(57) ABSTRACT

A cylinder liner for an engine cylinder block. A roughening process is performed only on an upper region of the outer surface of the cylinder liner. This increases adhesiveness with a sprayed layer at the upper region compared to a lower region of the liner outer surface. Therefore, difference in thermal conductance is produced in the axial direction of the cylinder liner. This maintains the wall temperature of the cylinder bore in an appropriate temperature range. Even if adhesiveness at the lower region of the liner outer surface is low, bottleneck-shaped projections are distributed on the liner outer surface. Thus, the bonding strength between the cylinder liner and the sprayed layer and the cylinder liner and the cylinder block via the sprayed layer is sufficient. This maintains the roundness of the cylinder bore and prevents fuel efficiency from being lowered by exhaust gas loss and mechanical loss.

12 Claims, 13 Drawing Sheets

FOREIGN PATENT DOCUMENTS

| | | | |
|---|---|---|---|
| DE | 103 47 510 | B3 | 4/2005 |
| EP | 1 504 833 | A1 | 2/2005 |
| JP | 2001-200751 | | 7/2001 |
| JP | 2002 339794 | A | 11/2002 |
| JP | 2004/308625 | | 11/2004 |
| WO | WO 2005/038073 | A2 | 4/2005 |

* cited by examiner

Manufacturing Process of Cylinder Liner

[Process for Forming A Concave Hole]

[StepJ−2]

Contour Map

First Contour Map

Second Contour Map

CYLINDER LINER, CYLINDER BLOCK, AND METHOD FOR MANUFACTURING CYLINDER LINER

BACKGROUND OF THE INVENTION

The present invention relates to a cylinder liner insert cast in casting metal when casting a cylinder block for an internal combustion engine to bond the cylinder liner to the cylinder block and form a cylinder bore, a cylinder block formed with such a cylinder liner, and a method for manufacturing a cylinder liner.

There is a type of an internal combustion engine having cylinder liners arranged in a cylinder block. For such an engine, there has been a proposal for a technique for decreasing the temperature difference between the upper and lower portions of a cylinder bore wall during operation of the engine to prevent the fuel efficiency from being lowered and the roundness of the cylinder bores from being decreased due to exhaust gas loss and mechanical loss (refer to, for example, Japanese Laid-Open Patent Publication No. 2001-200751). The technique of Japanese Laid-Open Patent Publication No. 2001-200751 coats an insulative material on the lower portion on the outer wall of each cylinder liner. This adjusts the cooling speed of coolant, which is in contact with the outer wall of the cylinder liner, and decreases the temperature difference between the upper and lower portions of the cylinder bore wall.

However, in Japanese Laid-Open Patent Publication No. 2001-200751, most of the outer surface of the cylinder liner is in contact with the coolant, and only a small portion of the outer surface is in contact with the cylinder block. Accordingly, the cylinder block does not sufficiently support the cylinder liner. It is thus difficult to keep the roundness of the cylinder bore in a satisfactory state.

To sufficiently support the cylinder liner with the cylinder block and keep the roundness of the cylinder bore in a satisfactory state, the outer surface of the cylinder liner may be insert cast in the cylinder block. This bonds the cylinder liner to the cylinder block.

When insert casting the cylinder liner described in Japanese Laid-Open Patent Publication No. 2001-200751 in a cylinder block, the insulative material coating the lower portion of the cylinder liner is made of ceramics. Thus, the bonding between the cylinder liner and the metal forming the cylinder block has a tendency to become insufficient. Therefore, especially, the lower portion of the cylinder liner cannot be sufficiently supported by the cylinder block. This may affect the roundness of the cylinder block.

In this manner, with the cylinder liner described in Japanese Laid-Open Patent Publication No. 2001-200751 that controls the difference in thermal conductivity between the upper and lower portions of the cylinder liner, the roundness of the cylinder bore cannot be sufficiently maintained.

SUMMARY OF THE INVENTION

The present invention provides a cylinder liner, used in a cylinder block, having a thermal conductivity difference in the axial direction, including an outer surface that exerts a sufficient bonding force on the cylinder block, and maintaining sufficient roundness of the cylinder bore. The present invention also provides a cylinder block using such a cylinder liner and a method for manufacturing such a cylinder liner.

One aspect of the present invention is a cylinder liner for bonding with a predetermined adhesiveness to a cylinder block of an internal combustion engine when casting the cylinder block. The cylinder liner includes an outer surface insert cast in casting metal directly or via an intermediate layer. A plurality of bottleneck-shaped projections are arranged on the outer surface. The adhesiveness between the outer surface and the cylinder block or the intermediate layer differs along an axial direction of the cylinder liner.

A further aspect of the present invention is a cast cylinder block for an internal combustion engine. The cylinder block includes a casting metal of light alloy material. A cylinder liner is insert cast in the casting metal and bonded with a predetermined adhesiveness to the cylinder block when casting the cylinder block. The cylinder liner includes an outer surface insert cast in the casting metal directly or via an intermediate layer. A plurality of bottleneck-shaped projections are arranged on the outer surface. The adhesiveness between the outer surface and the cylinder block or the intermediate layer differs along an axial direction of the cylinder liner.

Another aspect of the present invention is a method for manufacturing a cylinder liner for bonding to a cylinder block of an internal combustion engine when casting the cylinder block. The cylinder liner includes an outer surface having a plurality of bottleneck-shaped projections, an upper portion, and a lower portion, and is insert cast in casting metal. The method includes performing a roughening process only on the upper portion of the outer surface, and forming a sprayed layer on the outer surface by spraying the upper and lower portions of the outer surface with a metal spraying material.

A further aspect of the present invention is a method for manufacturing a cylinder liner for bonding to a cylinder block of an internal combustion engine when casting the cylinder block. The cylinder liner includes an outer surface having a plurality of bottleneck-shaped projections, an upper portion, and a lower portion, and is insert cast in casting metal. The method includes performing a roughening process on the upper and lower portions of the outer surface. The roughening process is performed more strongly on the upper portion than the lower portion. The method further includes forming a sprayed layer on the outer surface by spraying the upper and lower portions of the outer surface with a metal spraying material.

Another aspect of the present invention is a method for manufacturing a cylinder liner for bonding to a cylinder block of an internal combustion engine when casting the cylinder block. The cylinder liner includes an outer surface having a plurality of bottleneck-shaped projections, an upper portion, and a lower portion, and is insert cast in casting metal. The method includes forming a spray layer on the upper portion of the outer surface and a fume deposit layer on the lower portion of the outer surface by having a metal spraying material of molten spraying grains contact the outer surface of the cylinder liner and simultaneously having fumes produced in the periphery of the molten sprayed grains contact the lower portion of the outer surface. The method further includes forming a sprayed layer on the outer surface by spraying the upper and lower portions of the outer surface with a metal spraying material of molten spraying grains.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First Embodiment

Figure 1A:
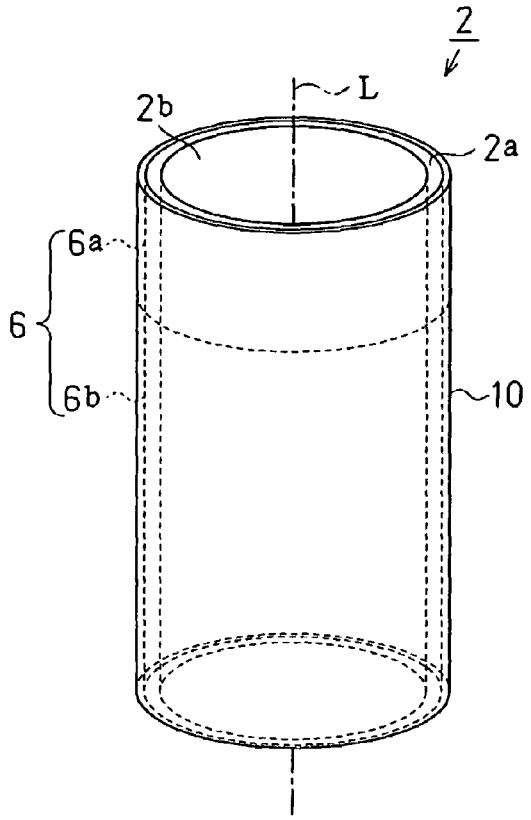
FIG. 1A is a perspective showing a cylinder liner according to a first embodiment of the present invention.
Figure 1B:
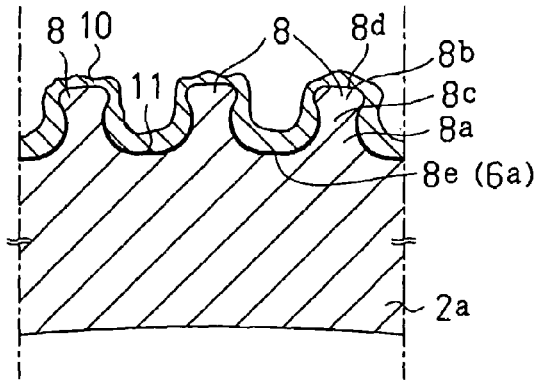
FIGS. 1B and 1C are partial cross-sectional views of the cylinder liner in the first embodiment.
Figure 1C:
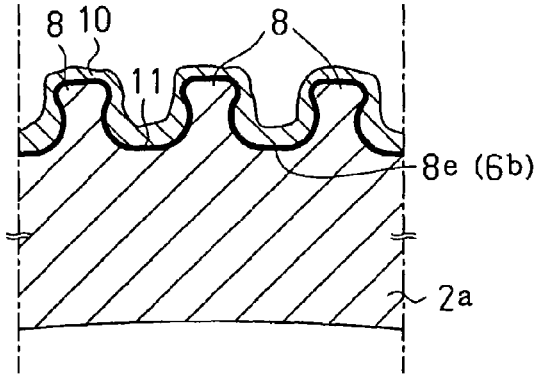
Figure 2B:
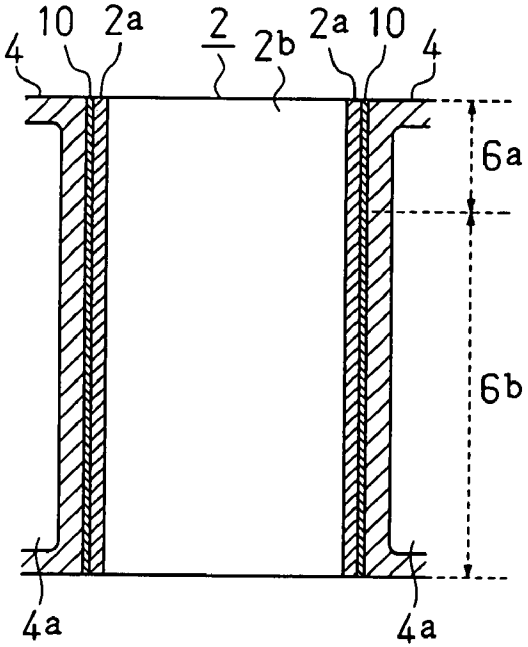
FIG. 2B is a partial cross-sectional view showing the cylinder block in the first embodiment.
Figure 2A:
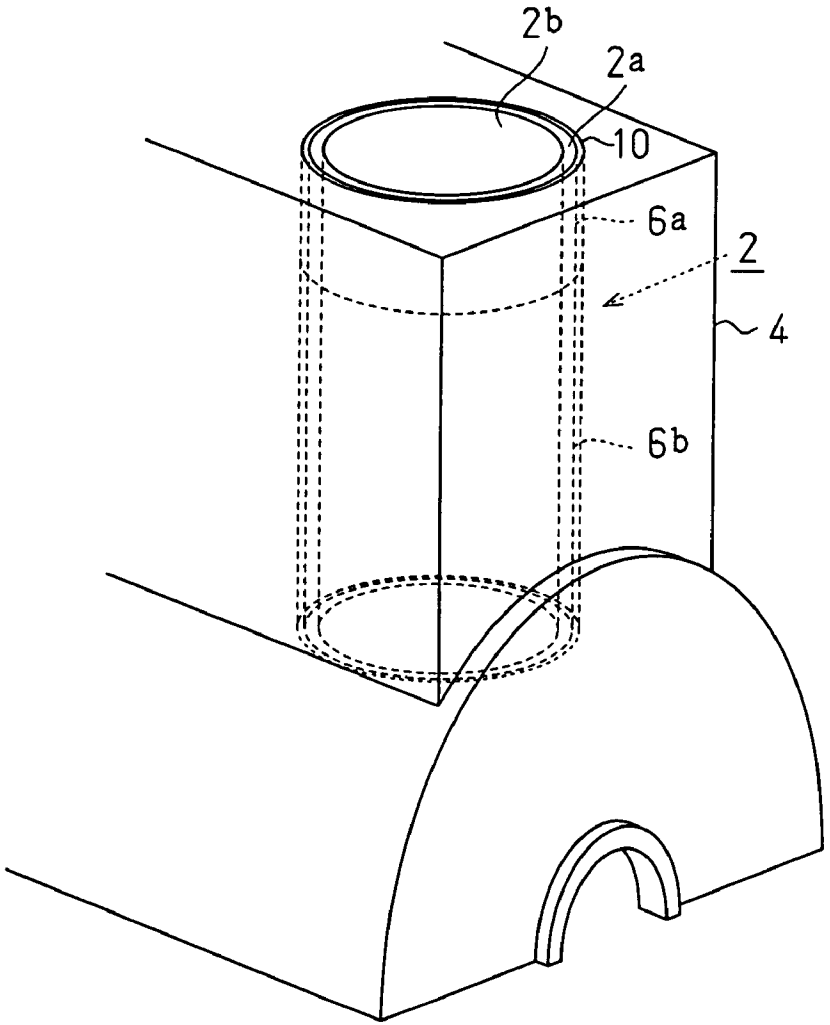
FIG. 2A is a perspective view showing a cylinder block in the first embodiment.

A first embodiment of the present invention will now be described with reference to FIGS. 1A to 2B. FIG. 1A is a perspective showing a cylinder liner 2 according to the present invention. FIG. 1B is an enlarged cross-sectional view showing the upper portion of the cylinder liner 2. FIG. 1C is an enlarged partial cross-sectional view showing the lower portion of the cylinder liner 2. FIG. 2A is a partial perspective view showing a cylinder block 4 using the cylinder liner 2. FIG. 2B is a partial cross-sectional view showing the cylinder block 4 using the cylinder liner 2.

<Structure of Cylinder Liner 2>

A main body 2*a* of the cylinder liner 2 shown in FIGS. 1A to 1C is made of cast iron. A plurality of bottleneck-shaped projections 8 are formed on the outer surface 6 of the cylinder liner main body 2*a* (hereinafter referred to as the "liner outer surface 6"). The projections 8 have the features listed below.

(1) Each projection 8 has a portion that is narrowest (narrowed portion 8*c*) at a location between a basal portion 8*a* and a distal portion 8*b*.

(2) Each projection 8 increases in diameter from the narrowed portion toward the basal portion 8*a* and toward the distal portion 8*b*.

(3) Each projection 8 has a generally flat top surface 8*d* (outermost surface in the radial direction of the cylinder liner 2) defined in the distal portion 8*b*.

(4) A generally smooth surface (bottom surface 8*e*) is formed between the projections 8.

FIG. 1A shows the projections 8, which are located outward from the bottom surfaces 8*e*, together with the sprayed layer 10. The state of the liner outer surface 6 differs in the direction of the axis L of the cylinder liner main body 2*a* between an upper region 6*a* and a lower region 6*b* of the liner outer surface 6. More specifically, the upper region 6*a* has a higher adhesiveness with respect to a sprayed layer 10, which is formed in the liner outer surface 6, compared to the lower region 6*b*. The difference in the adhesiveness is due to the roughening process that is performed only on the upper region 6*a*. As shown in FIG. 1B, this removes most of or all of a mill scale 11 of which the main component is a steel oxide formed on the cast iron. In the lower region 6*b*, none of the mill scale 11 is removed. During casting, a sprayed layer 10 on the liner outer surface 6 is bonded to the cylinder block 4 in a mechanical or metallurgical manner. Accordingly, referring to FIGS. 1B and 1C, the roughening of the upper region 6*a* increases the adhesiveness between the sprayed layer 10 and the liner outer surface 6 at the upper region 6*a*. However, since none of the lower region 6*b* undergoes roughening, the adhesiveness between the sprayed layer 10 and the liner outer surface 6 is low at the lower region 6*b*.

<Cylinder Liner 2 Manufacturing Process>

Figure 3:
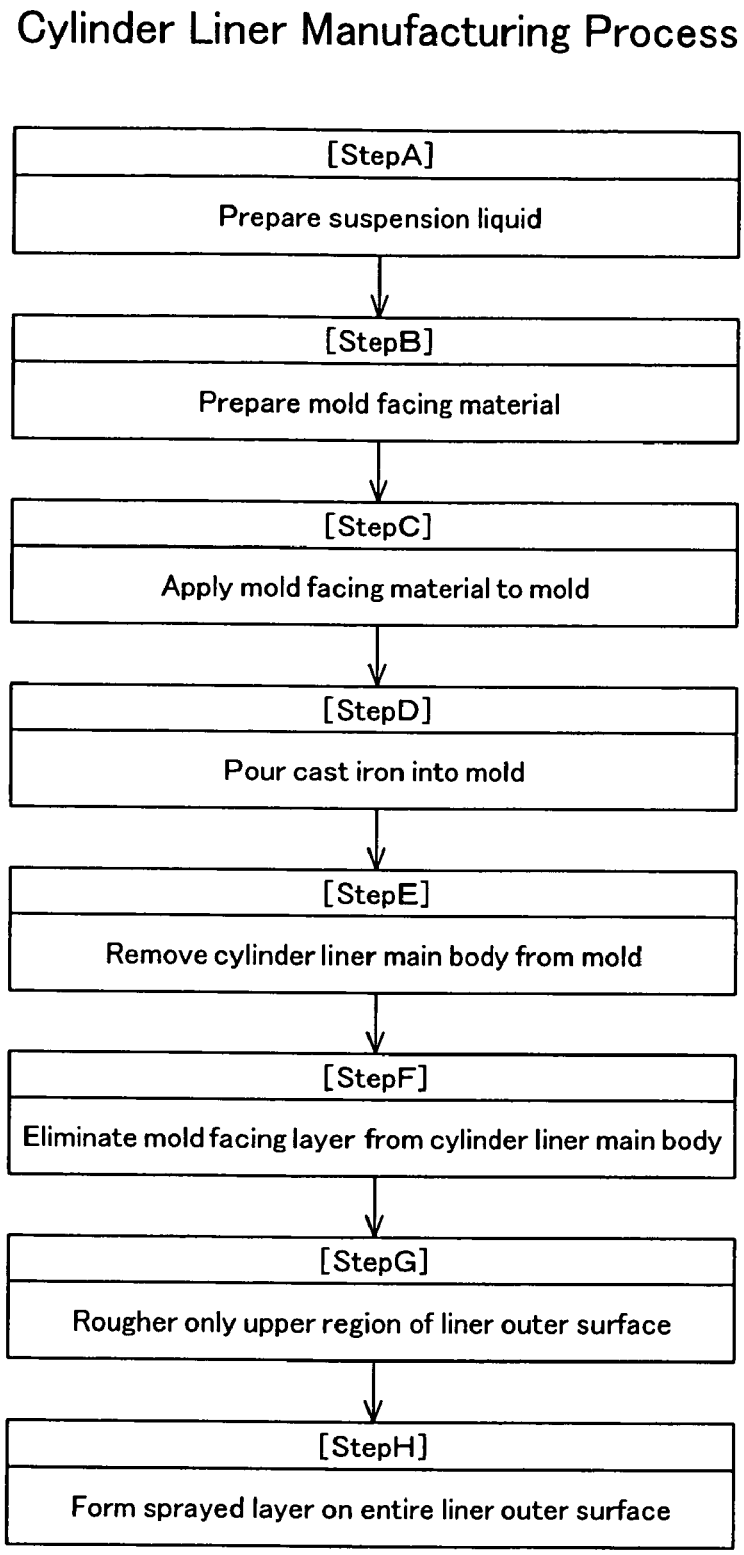
FIG. 3 is a flowchart showing the procedures for manufacturing the cylinder liner.
Figure 4:
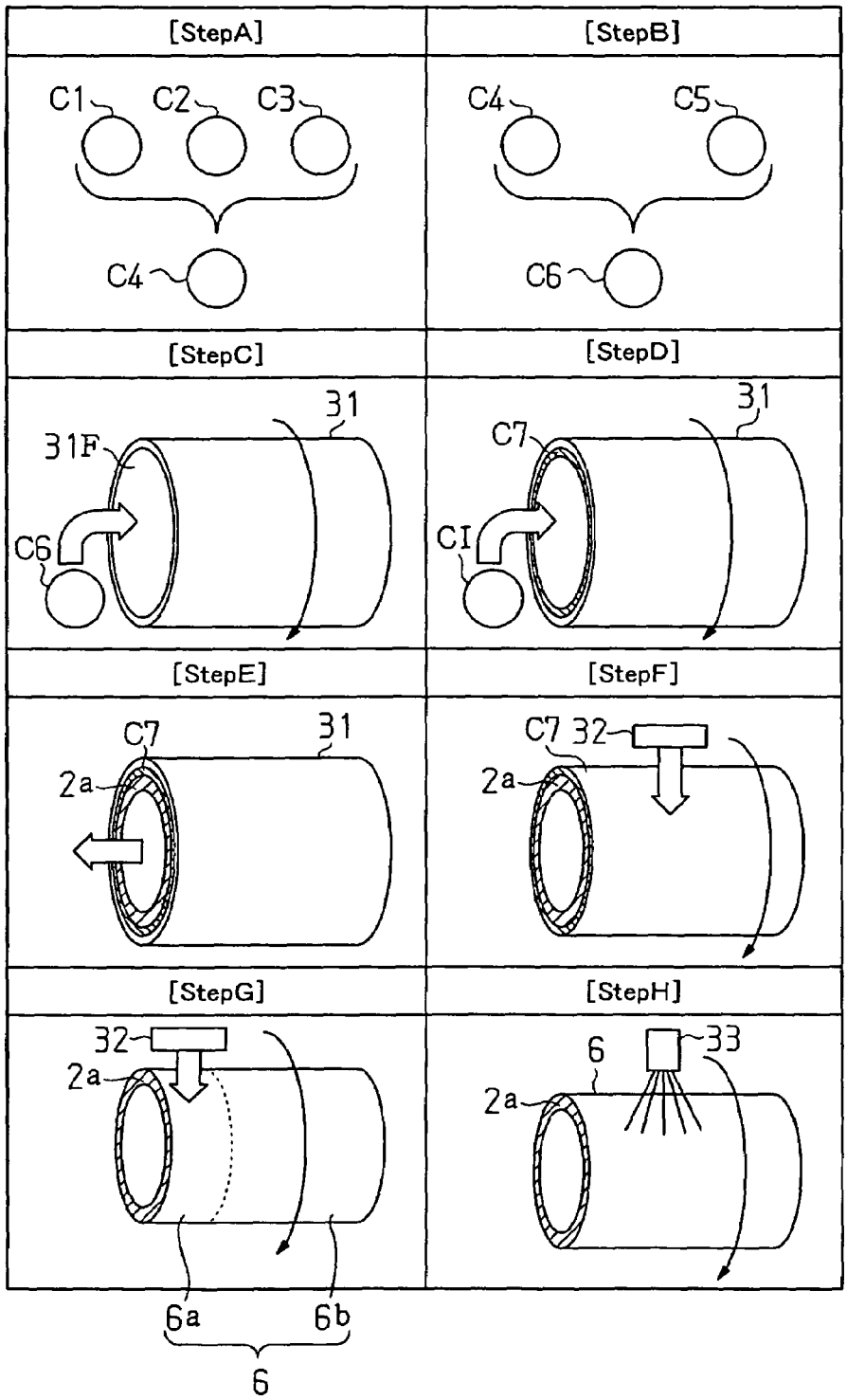
FIG. 4 is a schematic diagram showing the procedures for manufacturing the cylinder liner.

Steps A to H shown in FIG. 3 are performed to manufacture the cylinder liner 2. The manufacturing of the cylinder liner 2 will be described in detail with reference to FIG. 4.

[Step A]

A fire resistance base C1, a bonding agent C2, and water C3 are mixed at a predetermined ratio to prepare a suspension liquid C4. In the present embodiment, the ranges of the selectable compound amount for the fire resistance base C1, bonding agent C2, and water C3, and the average grain diameter of the fire resistance base C1 are set as shown below.

Compound amount of fire resistance base C1: 8% by mass to 30% by mass,

Compound amount of bonding agent C2: 2% by mass to 10% by mass,

Compound amount of water C3: 60% by mass to 90% by mass,

Average grain diameter of the fire resistance base C1: 0.02 mm to 0.1 mm.

[Step B]

A predetermined amount of a surface active agent C5 is added to the suspension liquid C4 to prepare a mold facing material C6. In the present embodiment, the range of the selectable additive amount of the surface active agent C5 is set as shown below.

The additive amount of the surface active agent C5: 0.005% by mass<X≦0.1% by mass (X being the additive amount of the surface active agent C5).

[Step C]

A mold 31 (casting mold) heated to a predetermined temperature is rotated to spray and apply the mold facing material C6 to the inner surface 31F of the mold 31. A layer (mold facing layer C7) of the mold facing material C6 is formed with a generally even thickness throughout the entire inner surface 31F of the mold 31. In the present embodiment, the range for the selectable thickness of the mold facing layer C7 is set as shown below.

Thickness of the mold facing layer C7: 0.5 mm to 1.5 mm

Figure 5:
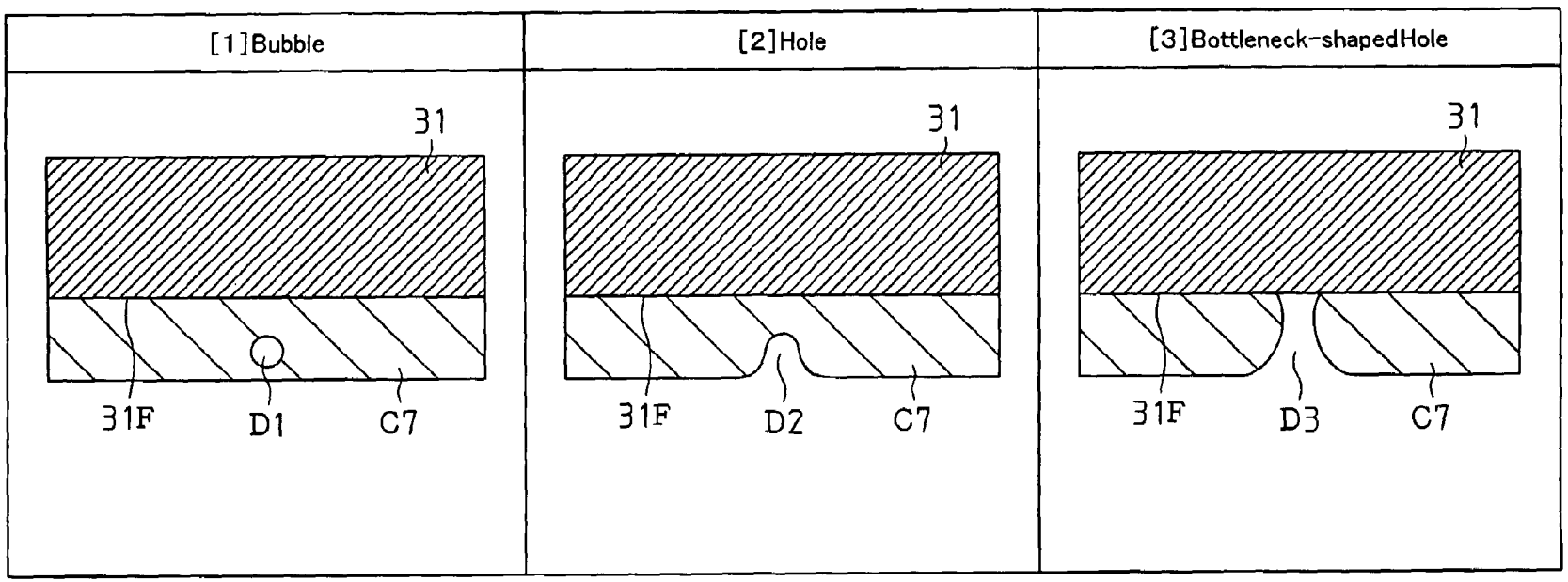
FIG. 5 is an explanatory diagram showing a process for forming a narrowed hole in a casting mold.

FIG. 5 shows a state in which a bottleneck-shaped hole is formed in the mold facing layer C7. As shown in FIG. 5, the surface active agent C5 acts on air bubbles D1 in the mold facing layer C7 and forms holes D2 in the surface of the mold facing layer C7. As each hole D2 extends to the inner surface 31F of the mold 31, a bottleneck-shaped hole D3 forms in the mold facing layer C7.

[Step D]

After drying the mold facing layer C7, liquid metal CI of cast iron is poured into the rotating mold 31 to cast the cylinder liner main body 2*a*. The shapes of the holes D3 are transferred to the outer surface of the cylinder liner main body 2*a* at positions corresponding to the holes D3 in the mold facing layer C7. This forms the bottleneck-shaped projections 8 (see FIGS. 1A to 1C).

[Step E]

After the liquid metal CI hardens and forms the cylinder liner main body 2*a*, the cylinder liner main body 2*a* is removed from the mold 31 together with the mold facing layer C7.

[Step F]

The mold facing layer C7 is eliminated from the outer surface of the cylinder liner main body 2*a* with a blast processing device 32.

[Step G] (Corresponding to Roughening Process)

A roughening process is performed on the upper region 6*a* (for example, the region of the liner outer surface 6 from the upper edge to about 50 mm therefrom) of the liner outer surface 6 with the roughening device (blast processing device 32 or other blast processing devices or a water jet device).

[Step H] (Corresponding to Vertical Spraying Step)

A spraying device 33 entirely sprays (wire sprays or sprays powders such as plasma or HVOF) the liner outer surface 6 with an aluminum spraying material, which is a metal spraying material of aluminum or an aluminum alloy.

<Area Ratio of Projections>

In the present embodiment, the selectable ranges of the first projection area ratio S1 and the second projection area ratio S2 of the projections subsequent to step F is set as shown below.

First projection area ratio S1: greater than or equal to 10%,

Second projection area ratio S2: less than or equal to 55%.

Alternatively, the ranges may be set as shown below.

First projection area ratio S1: 10% to 50%,

Second projection area ratio S2: 20% to 55%.

The first projection area ratio S is equivalent to the cross-sectional area of the projections 8 per unit area in a plane lying at a height of 0.4 mm from the bottom surface 8*e* (distance in the height direction of the projections 8 using the bottom surface 8*e* as a reference). The second projection area ratio S2 is equivalent to the cross-sectional area of the projections 8 per unit area in a plane lying at a height of 0.2 mm from the bottom surface 8*e* (distance in the height direction of the projections 8 using the bottom surface 8*e* as a reference). The area ratios S1 and S2 are obtained from contour maps (FIGS. 17 and 18) of the projections 8 generated by three-dimensional laser measuring device. The measurement does not have to be performed by a three-dimensional laser measuring device and may be performed by other measuring devices. This is the same for the other embodiments. The height and distribution density of the projections 8 are determined by the depth and distribution density of the holes D3 in the mold facing layer C7 formed in step C. The mold facing layer C7 is formed so that the height of the projections 8 is 0.5 mm to 1.5 mm, the number of the projections 8 is 5 to 60 per $cm^2$ on the liner outer surface 16.

<Composition of Cast Iron>

In the present embodiment, the composition of the cast iron is preferably set as shown below taking into consideration wear resistance, seizing resistance, and machinability.

T.C: 2.9% by mass to 3.7% by mass,

Si: 1.6% by mass to 2.8% by mass,

Mn: 0.5% by mass to 1.0% by mass,

P: 0.05% by mass to 0.4% by mass.

If necessary, the following compositions may be added.

Cr: 0.05% by mass to 0.4% by mass,

B: 0.03% by mass to 0.08% by mass,

Cu: 0.3% by mass to 0.5% by mass.

<Structure and Manufacturing of Cylinder Block 4>

The cylinder block 4 is formed so that the cylinder liner 2 is insert cast in the sprayed layer 10 formed on the liner outer surface 6. by the cast metal. A light alloy material is used as the cast metal for forming the cylinder block. In particular, aluminum or aluminum alloy may be used from the viewpoint of decreasing weight and cost. The materials described in, for example, "JIS ADC10 (corresponding standard: US ASTM A380.0)", "JIS ADC12 (corresponding standard: ASTM A383.0)" are used as the aluminum alloy. The cylinder liner 2 shown in FIGS. 1A to 1C is arranged in a casting mold. Then, liquid metal of an aluminum material is poured into the casting mold. This forms the cylinder block 4 with the entire periphery of the sprayed layer 10 insert cast in the aluminum material.

<Measurement of Adhesiveness>

With regard to the adhesiveness between the sprayed layer 10, which is formed in step G, and the liner outer surface 6, due to the roughening process performed in step H only on the upper region 6*a* of the liner outer surface 6, the occurrence of a difference between the upper region 6*a* and the lower region 6*b* was confirmed through the measurement described below. First, a plurality of cylinder liner main bodies used for adhesiveness measurement was manufactured through centrifugal casting using cast iron corresponding to FC230 using a mold that does not have the holes D3 (see FIG. 5). The following three types (A to C) of processes were performed on the adhesiveness measurement cylinder liner main bodies to form the sprayed layers.

A. Subsequent to the roughening process performed on the outer surface of the adhesiveness measurement cylinder liner main bodies, a sprayed layer was formed through spraying (Al-12Si wire arc spraying). (The roughening process is performed through a shot blasting treatment but may be performed through a water jet treatment instead.)

B. The roughening process was eliminated, and the sprayed layer was formed through spraying (Al-12Si wire arc spraying) in a state in which the adhesiveness measuring cylinder liner main bodies were heated. (This process was performed to simulate spraying in a state in which the distal end of the projections 8 (FIGS. 1A to 1C) were hot due to casting).

C. The heating and roughening processes were eliminated, and the sprayed layer was formed through spraying (Al-12Si wire arc spraying).

Figure 6:
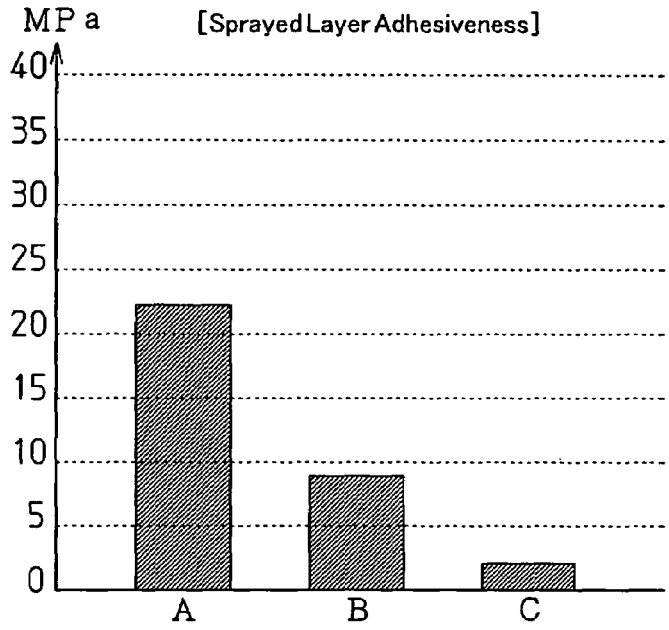
FIG. 6 is a graph showing the adhesive strength between a cylinder liner main body and a sprayed layer in the first embodiment.

For the adhesiveness measurement cylinder liners formed through the three types of processes A to C, the adhesiveness (MPa) between the adhesiveness measurement cylinder liner main body and the sprayed layer was measured by conducting a tensile test. The results are shown in the graph of FIG. 6. As apparent from the graph, the adhesiveness is drastically lowered when the roughening process is eliminated. Thus, in the cylinder liner 2 of the present embodiment shown in FIGS. 1A to 1C, the adhesiveness between the cylinder liner main body 2*a* and the sprayed layer 10 is high in the upper region 6*a* but much lower in the lower region 6*b*. Thus, when a liquid metal of the aluminum material is poured into the casting mold after the cylinder liner 2 is arranged therein, the high temperature during insert molding and the subsequent cooling that causes thermal contraction causes removal of the sprayed layer 10 from the cylinder liner main body 2*a* at the lower region 6*b* and forms a gap therebetween. The gap is small or does not axis at all at the upper region 6*a*.

As described above, even if gaps are formed due to the low adhesiveness, the projections 8 function to firmly bond the sprayed layer 10 and the cylinder liner main body 2*a*, and a sufficient bonding force is provided between the cylinder liner 2 and the cylinder block 4 by means of the sprayed layer 10. Accordingly, the cylinder liner 2 is fixed in the cylinder block 4 and the support provided by cylinder block 4 keeps the roundness of the cylinder bore 2*b* sufficiently high. Further, due to the difference in adhesiveness, at the upper region 6*a* of the cylinder liner 2, the heat of the cylinder bore 2*b* is easily transmitted to the cylinder block 4. Comparatively, at the lower region 6*b* of the cylinder liner 2, it is difficult to transmit the heat of the cylinder bore 2*b* to the cylinder block 4. Thus, the cooling efficiency is high at the upper region 6*a*, at which the temperature easily increases, and low at the lower region 6*a*, at which it is difficult for the temperature to increase. The thermal conductivity rate (W/mK) of each material forming the cylinder liner main body 2*a*, the cylinder block 4, and the sprayed layer 10 are shown in table 1.

TABLE 1

| Part | Material | Thermal Conductivity Rate (W/mK) |
|---|---|---|
| Cylinder Liner | FC230 | 41.7 |
| Cylinder Block | ADC12 | 127 |
| Sprayed Layer | Al-12Si | 41.5 |
| Sprayed Layer | Pure Al | 66.7 |

In this manner, in the present embodiment, in comparison with the cylinder block 4, the cylinder liner main body 2*a* and the sprayed layer 10 having a difference in adhesiveness at the boundary portion therebetween are both formed by a material having thermal conductivity rate that is sufficiently small compared to the cylinder block 4. Therefore, a decrease in the adhesiveness is particularly notable as it results in a decrease in the heat conductance speed between the cylinder liner main body 2*a* and the sprayed layer 10. The heat transfer between the cylinder liner main body 2*a* and the sprayed layer 10 occurs not only through heat conductance but also through other means of heat transfer such as heat radiation. However, in the present embodiments, all of such means of heat transfer are referred to as "heat conductance".

<Measurement of Bore Wall Temperature>

A cylinder block for a 1600 cc, four cylinder internal combustion engine was formed by insert casting cylinder liners (a-d) having different liner outer surface states as described below was formed as shown in FIGS. 2A and 2B.

a. Comparative Example 1: Cylinder liner formed through steps A to F (roughening process and formation of sprayed layer were not performed).

b. Comparative Example 2: Cylinder liner formed through steps A to H. In step G, the roughening process was evenly performed on the entire liner outer surface including the upper region 6*a* and the lower region 6*b*. In step H, the sprayed layer was formed.

c. Example 1: Cylinder liner formed through steps A to H. In step G, the roughening process was performed only on the upper region 6*a* by conducting shot blasting.

d. Example 2: Cylinder liner formed through steps A to H. In step G, the roughening process was performed only on the upper region 6*a* by conducting the water jet treatment.

Figure 7:
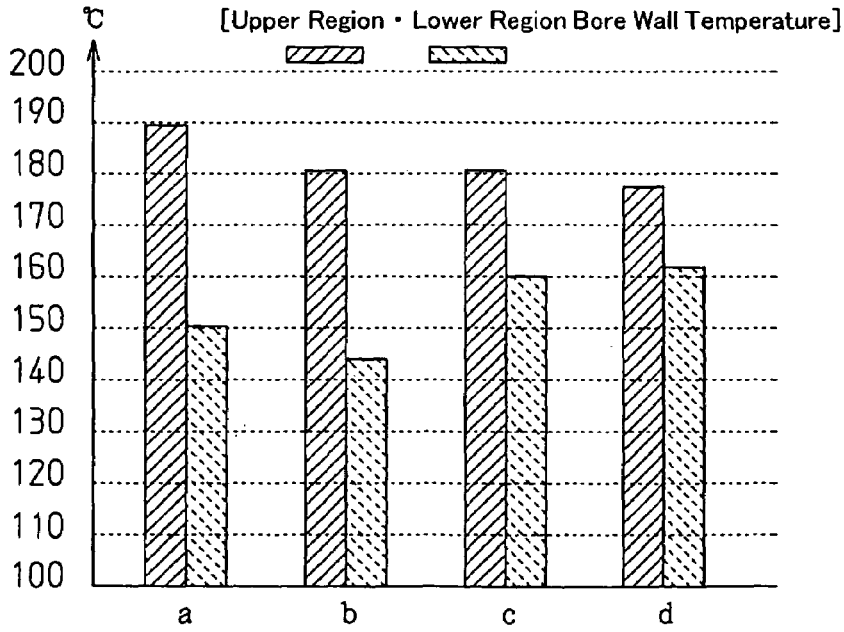
FIG. 7 is a graph showing the difference in bore wall temperature between upper and lower regions of the cylinder liner of the first embodiment.
Figure 8:
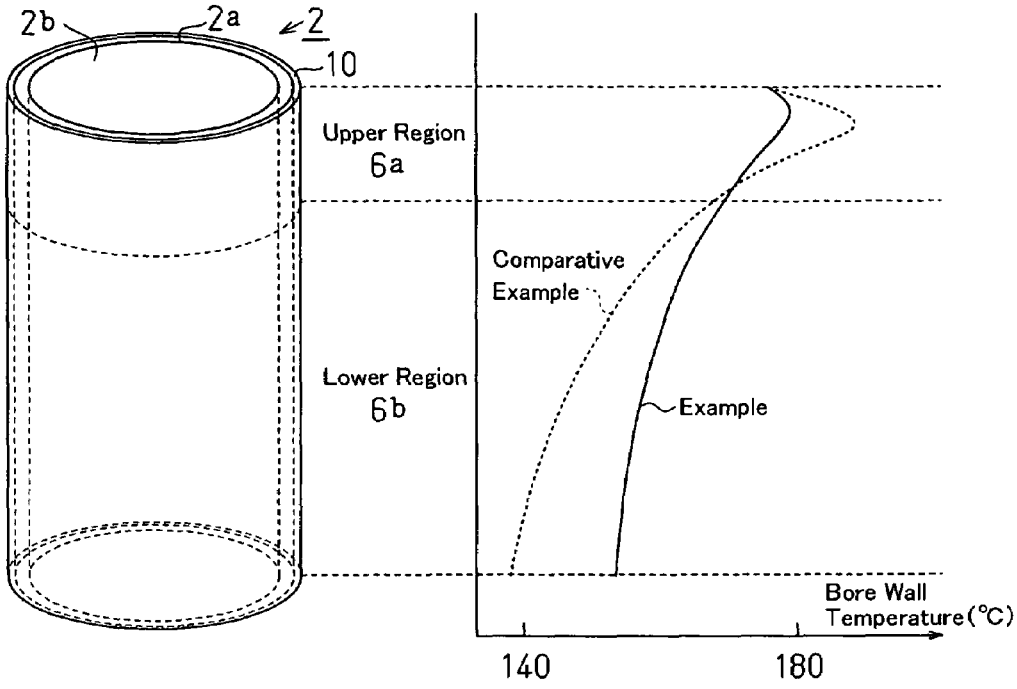
FIG. 8 is a diagram showing the bore wall temperature distribution of the cylinder liner of the first embodiment.

In cylinder blocks having the four types of cylinder liners insert cast therein, the bore wall temperature was measured for each cylinder liner during the operation of the internal combustion engine at positions located 10 mm (upper region) from the upper surface (head surface) of the cylinder block and 90 mm (lower region) from the upper surface. The results are shown in the graph of FIG. 7. As apparent from the graph, in the cylinder blocks in which the cylinder liners "a" and "b" of the comparative examples 1 and 2 are insert cast, there is a large temperature difference between the 10 mm location and the 90 mm location. In the cylinder blocks in which the cylinder liners "c" and "d" of the examples 1 and 2 are insert cast, the temperature difference between the 10 mm location and the 90 mm location is about one half of that of the comparative examples 1 and 2. Thus, as shown by the solid line in FIG. 8, the difference between the wall temperatures of the upper region 6*a* and the lower region 6*b* becomes small, and the wall temperature of the entire cylinder bore 2*b* may be set within an appropriate temperature range. The broken line in FIG. 8 shows a temperature distribution example of the cylinder liner (b) to which the roughening process is evenly performed on both of the upper region 6*a* and the lower region 6*b*.

The first embodiment has the advantages described below.

The adhesiveness of the liner outer surface 6, which is the outer surface of the cylinder liner main body 2*a*, and the sprayed layer, which corresponds to an intermediate layer, differs in the direction of the axis L of the cylinder liner main body 2*a*. More specifically, the adhesiveness is high at the upper region 6*a* and low at the lower region 6*b*. In the present embodiment, the roughening process is performed only on the upper region 6*a* in step G to easily realize such difference in adhesiveness.

The combustion heat generated in the cylinder bore 2*b* during the operation of the internal combustion engine is transmitted from the cylinder liner main body 2*a* via the sprayed layer 10 to the aluminum cylinder block 4. Due to the difference in adhesiveness between the upper region 6*a* and the lower region 6*b*, the amount of heat transfer from the cylinder liner main body 2*a* to the sprayed layer 10 is high at the upper region 6*a* and low at the lower region 6*b*. This facilitates the discharge of heat to the cylinder block 4 from the upper region 6*a*, which receives a large amount of heat from the interior of the cylinder bore 2*b*, and hinders the discharge of heat to the cylinder block 4 from the lower region 6*b*, which receives a small amount of heat from the interior of the cylinder bore 2*b*. Accordingly, the wall temperature of the cylinder bore 2*b* becomes close at the upper and lower portions of the cylinder bore 2*b*, and the wall temperature in the cylinder bore 2*b* may be entirely set in the appropriate temperature range. Even if the adhesiveness of the liner outer surface 6 decreases, the bottleneck-shaped projections 8 are distributed throughout the entire liner outer surface 6. Thus, the bonding force between the cylinder liner main body 2*a* and the sprayed layer 10 and the bonding force between the cylinder liner main body 2*a* and the cylinder block 4 are sufficiently high. This maintains the roundness of the cylinder bore 2*b* at a sufficiently high level.

Figure 9A:
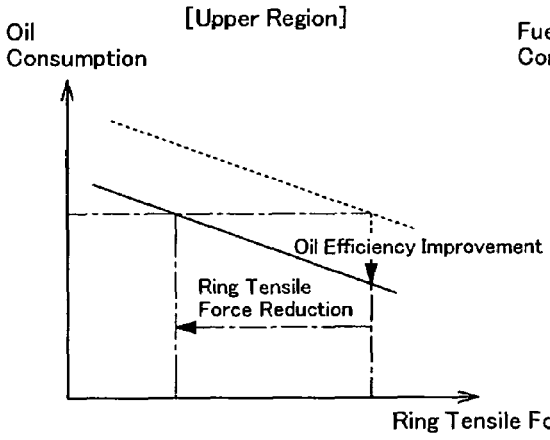
FIGS. 9A and 9B are graphs showing the effects of the first embodiment.
Figure 9B:
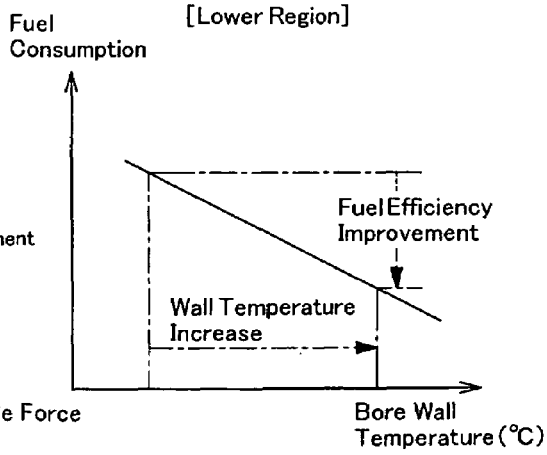

Referring to FIG. 9A, in the upper region 6*a* of the aluminum cylinder block 4 in which the cylinder liner 2 is insert cast, the decrease in the wall temperature of the cylinder bore 2*b* lowers the consumption of engine oil. This may lower the ring tension of the piston retained in the cylinder bore 2*b*. Further, as shown in FIG. 9B, in the lower region, the increase in the wall temperature of the cylinder bore 2*b* lowers the oil film viscosity in the cylinder bore 2*b*. As a result, mechanical loss of the internal combustion engine is reduced and the roundness of the cylinder bore 2*b* is maintained as described above. This prevents the fuel efficiency from being lowered by discharge gas loss or mechanical loss and maintains satisfactory fuel efficiency.

Second Embodiment

In the second embodiment, steps I and J, which are shown in FIGS. 10 to 13, are performed in lieu of steps G and H of the first embodiment.

[Step I]

Figure 10:
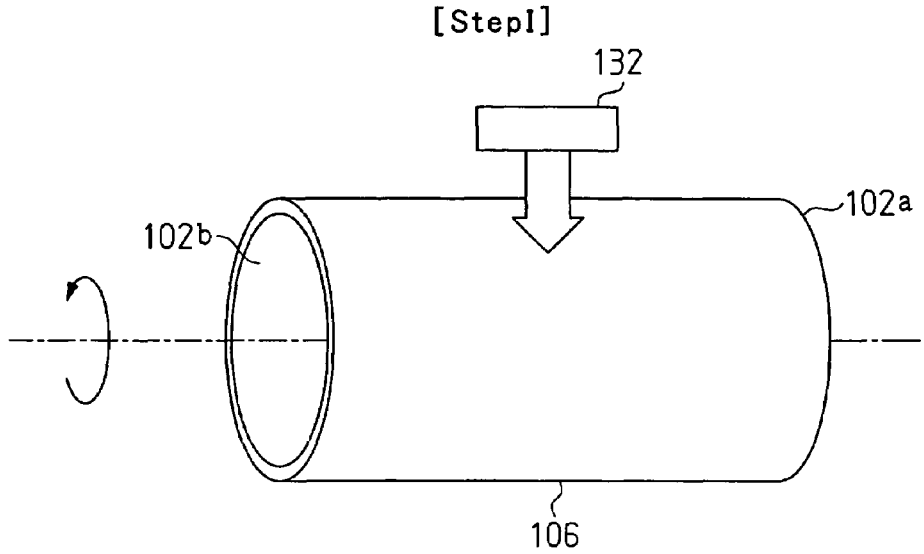
FIG. 10 is a diagram showing a roughening process performed in a cylinder liner main body according to a second embodiment of the present invention.

As shown in FIG. 10, a roughening process is evenly performed on the entire liner outer surface 106 of the cylinder liner main body 102*a*, which is formed through steps A to F in the same manner as the first embodiment, with a roughening device (the blast processing device 32 or other blast processing devices or a water jet device) 132.

[Step J]

Figure 11:
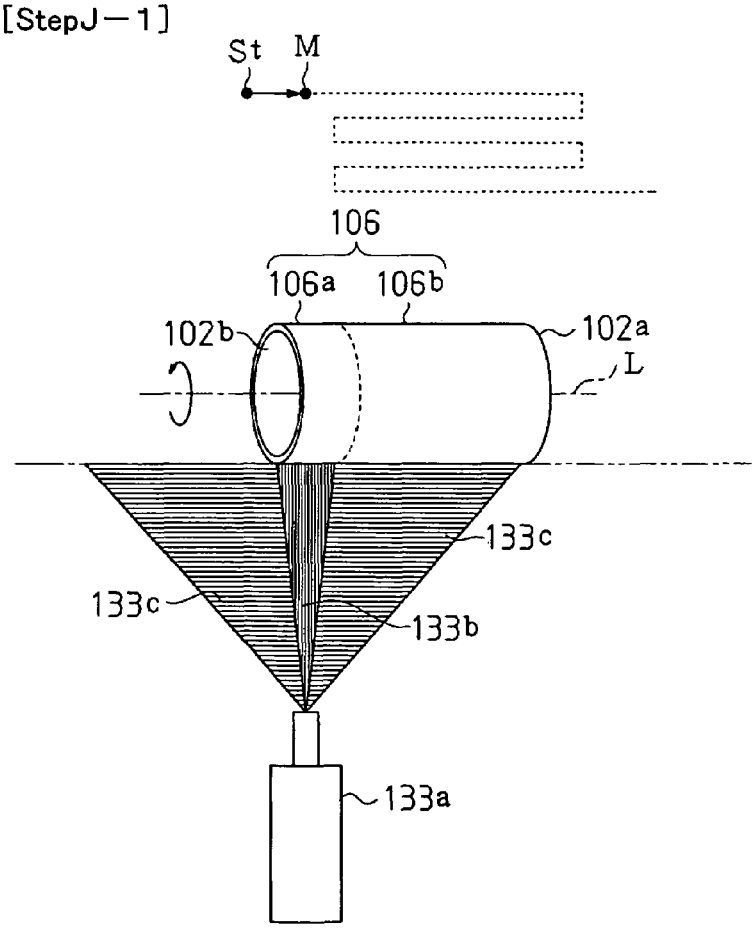
FIG. 11 is a diagram showing a selective spraying process performed on the cylinder liner main body of the second embodiment.
Figure 12:
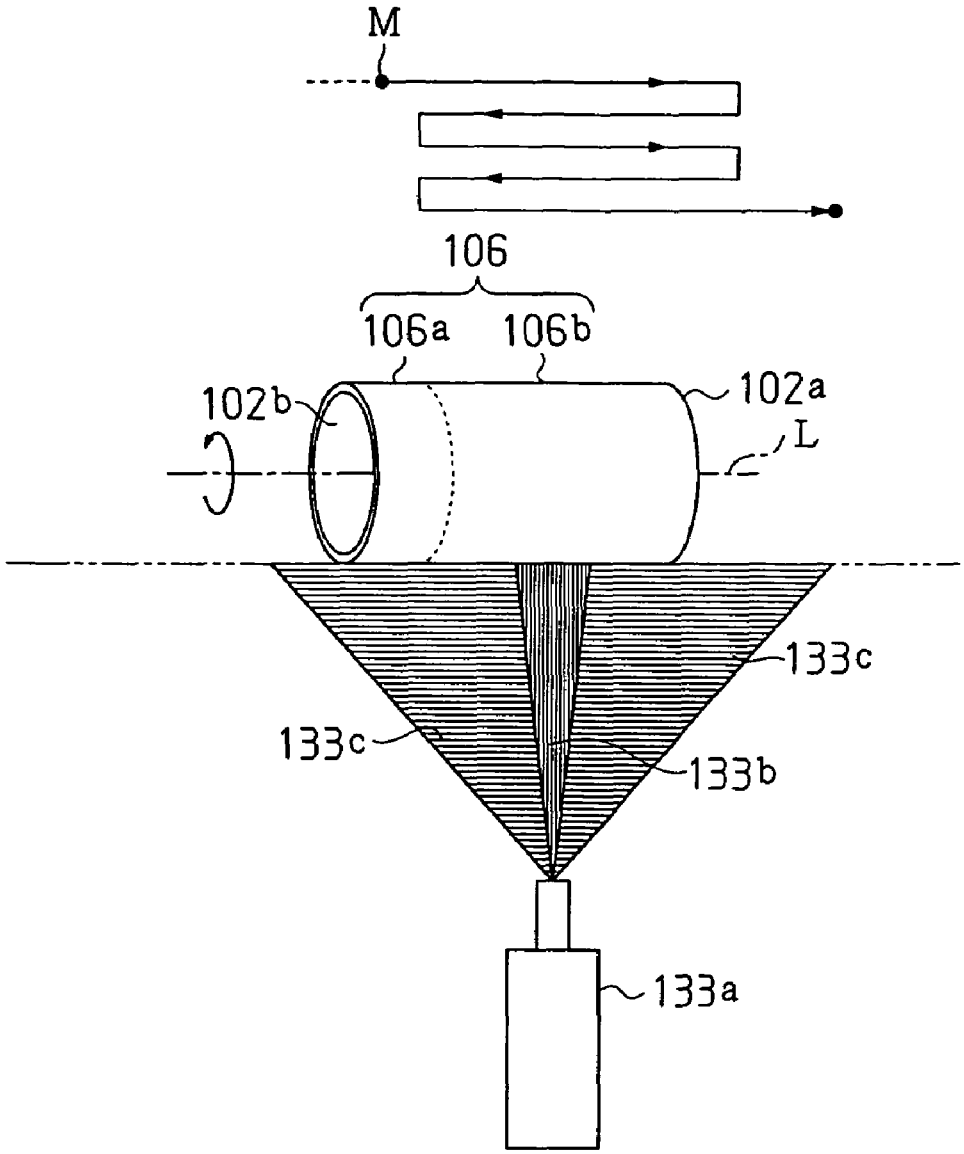
FIG. 12 is a diagram showing a vertical spraying process performed on the cylinder liner main body of the second embodiment.

As shown in FIGS. 11 and 12, in sub-steps J-1 and J-2, a spraying device entirely sprays (wire sprays or sprays powders such as plasma or HVOF) the liner outer surface 106 of the cylinder liner main body 102*a*, which has undergone the roughening process of step I. The spraying material is an aluminum spraying material of aluminum or an aluminum alloy.

The sub-steps J-1 and J-2, which are the procedures for forming a sprayed layer 116, will now be described.

[Sub-Step J-1] (Corresponding to Selective Spraying Step)

Figure 13A:
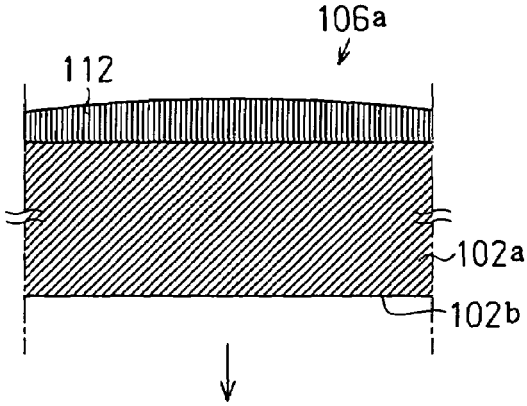
FIGS. 13A to 13D are cross-sectional diagrams showing a layer formed on the liner outer surface in the second embodiment.
Figure 13B:
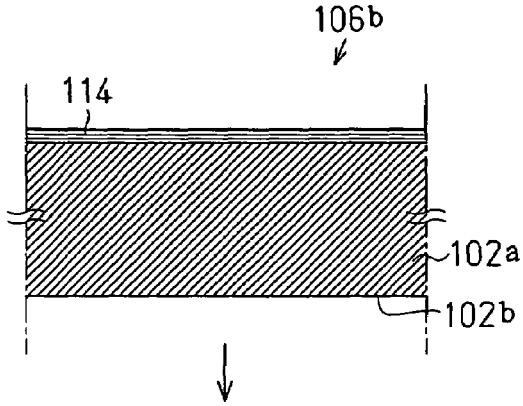

As shown by the solid line arrow in FIG. 11, a spray gun 133*a* is moved along the axis L of the rotating cylinder liner main body 102 from the spray starting position St to position M at which molten spraying grains 133*b* contact the entire upper region 106*a*. The spray gun 133*a* is moved at a velocity that achieves a target sprayed layer thickness in a single pass. At position M, the spray gun 133*a* is temporarily stopped in a state in which the spray gun 133*a* continues spraying. At the same time as the spraying, fumes 133*c* are ejected around and in the periphery of the molten spraying grains 133*b*. The fumes 133*c*, which are formed by fine oxides and fine solid grains, function as a substance for hindering adhesion. The lower region 106*b* is free of masking, which would prevent the fumes 133*c* from contacting the lower region 106*b*. Thus, the fumes 133*c* come into direct contact with the lower region 106*b* and deposits on the lower region 106*b*. In this stopped state, the length of the spraying period is the length during which the fumes 133*c* deposited on the lower region 106*b* decreases adhesion and is determined beforehand through experiments. This forms a partial sprayed layer 112 on the upper region 106*a*, as shown in FIG. 13A, and a fume deposit layer 114 on the lower region 106*b*, as shown in FIG. 13B.

[Sub-Step J-2] (Corresponding to Vertical Spraying Step)

After the spraying period ends in a state stopped at position M in sub-step J-1, the spray gun 133*a* is moved in a plurality of passes along axis L as shown in FIG. 12. After spraying the upper region 106*a* and the lower region 106*b* (mainly, the lower region 106*b*), the spraying ends. As shown by the solid arrow in FIG. 12, the spray gun 133*a* ends spraying in five passes. The plurality of spraying passes evenly forms the sprayed layer 116 having the target sprayed layer thickness on the liner outer surface 106, which includes part of the upper region 106*a*. This forms the sprayed layer 116 as the uppermost layer on the entire liner outer surface 106. As for the lower region 106*b*, the fume deposit layer 114 formed in sub-step J-1 is present under the sprayed layer 116. This forms the cylinder liner of the present embodiment. Further, in sub-step J-2, the fumes 133*c* come into contact with the liner outer surface 106 but do not directly contact the cylinder liner main body 102*a* and are diffused in the sprayed layer 116 by the molten spraying grains 133*b*. Thus, the fumes 133*c* in sub-step J-2 do not affect adhesiveness.

<Measurement of Adhesiveness>

Figure 13C:
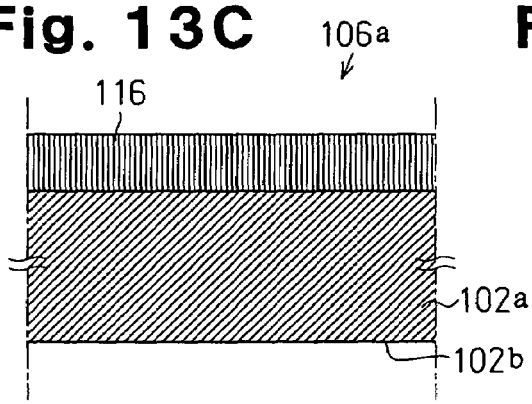
Figure 13D:
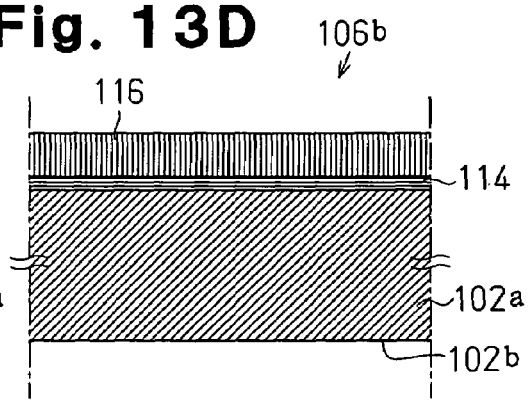

To check changes in the adhesiveness of the sprayed layer 116 depending on whether or not the fume deposit layer 114 is present, two cylinder liners that do not have the projections 8 (FIGS. 1B and 1C) were prepared. In one cylinder liner Ja, the spraying process was performed on the upper regions 106*a* in sub-steps J-1 and J-2 to form the sprayed layer 116 as shown in FIG. 13C. In the other cylinder liner Jb, the spraying process was performed on the lower region 106*b* to form the fume deposit layer 114 and the sprayed layer 116 as shown in FIG. 13D.

Figure 14:
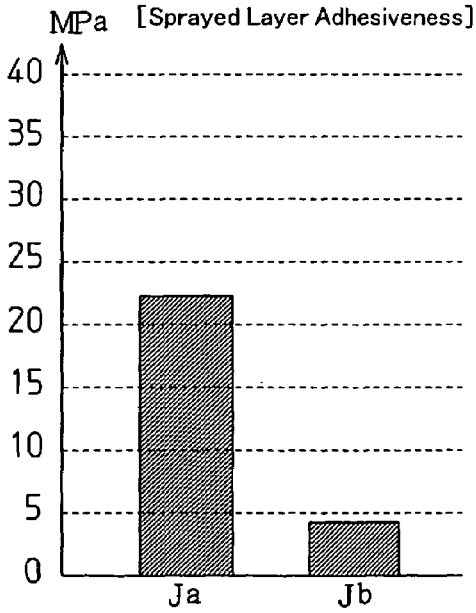
FIG. 14 is a graph showing the adhesive strength between a cylinder liner main body and a sprayed layer in the second embodiment.

The measurement result of the tensile strength (MPa) of the sprayed layer 116 formed on the cylinder liners Ja and Jb are shown in FIG. 14. As shown in FIG. 14, the fume deposit layer 114 located under the sprayed layer 116, or between the liner outer surface 106 and the sprayed layer 116, drastically decreases the adhesiveness between the liner outer surface 106 and the sprayed layer 116. In a cylinder block in which the cylinder liner of the present embodiment is insert cast, the projections 8 sufficiently bond the cylinder liner and the cylinder block even at the lower region 106*b* at which the bonding is achieved by the fume deposit layer 114 and the sprayed layer 116.

The second embodiment has the advantages described below.

The adhesiveness of the liner outer surface 106 is high at the upper region 106*a* and low at the lower region 106*b*. In the present embodiment, the entire liner outer surface 106 is evenly roughened in step I. However, in step J, the fume deposit layer 114 is formed between the sprayed layer 116 and the liner outer surface 106 only at the lower region 106*b*. This easily obtains a difference in adhesiveness between the upper region 106*a* and the lower region 106*b*.

As described in the first embodiment, due to the difference in adhesiveness between the upper region 106*a* and the lower region 106*b*, the heat conductivity from the cylinder liner main body 102*a* to the sprayed layer 116 is high at the upper region 106*a* and low at the lower region 106*b*. Accordingly, the wall temperature of the cylinder bore 102*b* becomes close at the upper and lower regions of the cylinder bore 102*b*, and the wall temperature in the cylinder bore 102*b* may be entirely set in the appropriate temperature range. Even if the adhesiveness of the sprayed layer 116 decreases due to the fume deposit layer 114 in the lower region 106*b*, the bottleneck-shaped projections 8 are distributed throughout the entire liner outer surface 106. Thus, the bonding force between the cylinder liner main body 102*a* and the sprayed layer 116 and the bonding force between the cylinder liner main body 2*a* and the cylinder block 4 by means of the sprayed layer 116 are sufficiently high. This maintains the roundness of the cylinder bore 102*b* at a sufficiently high level. As a result, in the same manner as the first embodiment, the fuel efficiency is prevented from being lowered by discharge gas loss or mechanical loss and satisfactory fuel efficiency is maintained.

The fume deposit layer 114 is formed at the same time as part of the sprayed layer 116 (partial sprayed layer 112) during the spraying process. This efficiently provides a difference in adherence between the upper region 106*a* and the lower region 106*b*. Further, the sprayed layer 116 is formed on the fume deposit layer 114. Thus, the fume deposit layer 114, which is easily removed, is protected by the sprayed layer 116. Accordingly, the fume deposit layer 114 is not eliminated when the cylinder liner is being transported, and changes in the adhesiveness difference during the period from when the cylinder liner is manufactured to when the cylinder liner is insert cast in the cylinder block are prevented from occurring.

Third Embodiment

Figure 15:
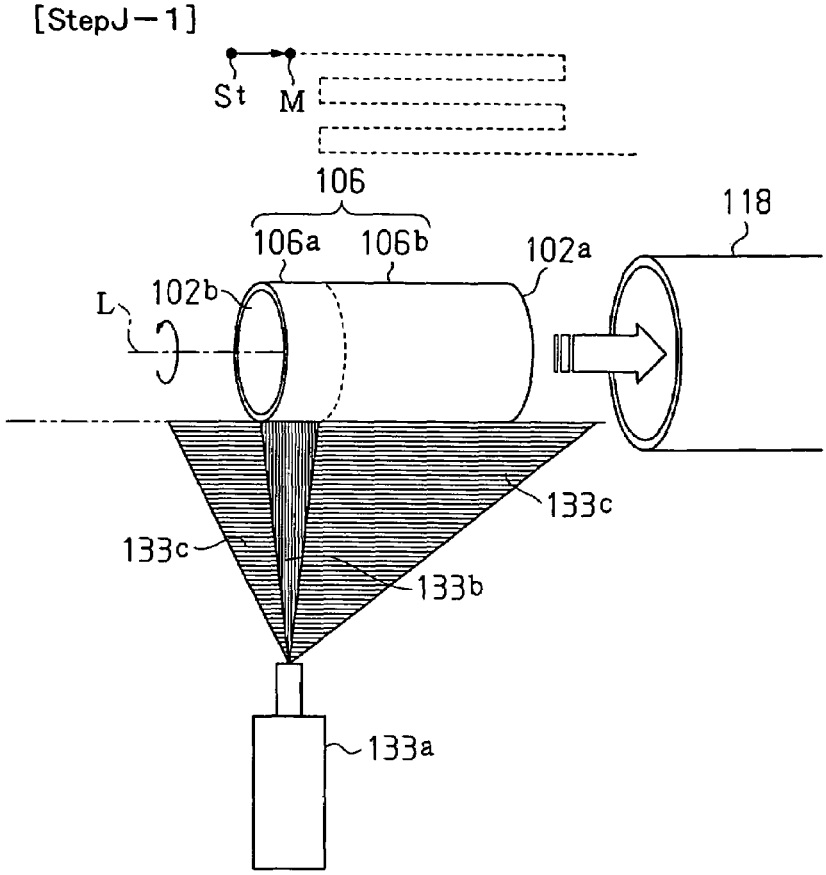
FIG. 15 is a diagram showing a selective spraying process performed on a cylinder liner main body according to a third embodiment of the present invention.

In the third embodiment, during sub-step J-1 of the second embodiment, the partial sprayed layer 112 and the fume deposit layer 114 are formed in a state in which the air around the cylinder liner main body 102*a* is drawn toward the lower region 106*b* from the upper region 106*a* by a discharge duct (corresponding to suction device) as shown in FIG. 15. This ensures that the fumes 133*c* evenly contact the lower region 106*b*. The other steps are the same as those in the second embodiment.

<Measurement of Adhesiveness>

To check changes in the adhesiveness of the sprayed layer 116 that depends on the presence of the fume deposit layer 114 of the present embodiment, a cylinder liner Jc that does not have projections 8 was prepared. The same process as the spraying process performed on the lower region 106*b* was performed through sub-step J-1 shown in FIG. 15 and sub-step J-2 of the second embodiment shown in FIG. 12, the fume deposit layer 114 and the sprayed layer 116 were formed on the cylinder liner Jc.

Figure 16:
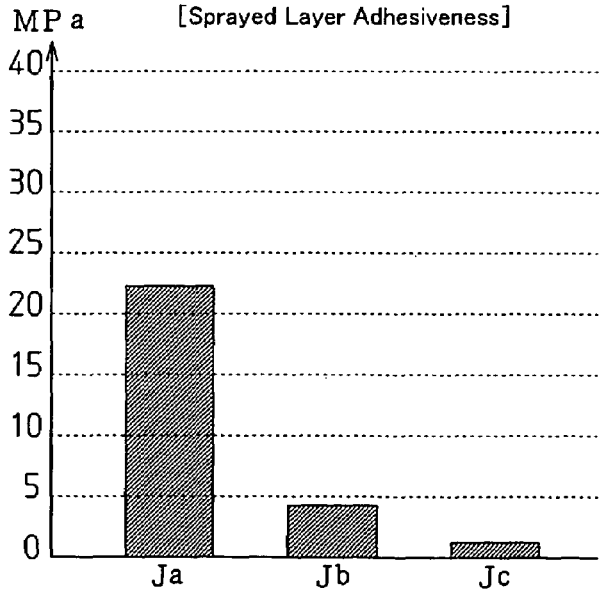
FIG. 16 is a graph showing the adhesive strength between a cylinder liner main body and a sprayed layer in the third embodiment.

The tensile strength (MPa) of the sprayed layer 116 formed on the cylinder liner Jc was measured. The measurement results are shown in FIG. 16 together with the data of the cylinder liners Ja and Jb of the second embodiment. As shown in FIG. 16, for cylinder liner Jc, the fume deposit layer 114 is sufficiently formed on the entire lower region 106*b*. Thus, in comparison with the cylinder liner Jb of the second embodiment, the adhesiveness is further decreased. In the cylinder block in which the cylinder liner of the present embodiment is insert cast, the cylinder liner and the cylinder block are sufficiently bonded by the projections 8 even if the adhesiveness is drastically decreased on the lower region 106*b*.

The third embodiment has the advantages described below.

The third embodiment has the advantages of the second embodiment. Additionally, the third embodiment ensures the formation of the fume deposit layer 114 in the lower region 106*b*. Further, the thickness of the fume deposit layer 114 may be controlled by adjusting the suction force of the discharge duct 118. This enables highly accurate adjustment of the difference in adhesiveness and the state of thermal conductance.

[Description of Contour Map of Projections]

A contour map of the projections 8 obtained with a three-dimensional laser measuring device will now be discussed.

<Contour Map of Projections 8>

Figure 17A:
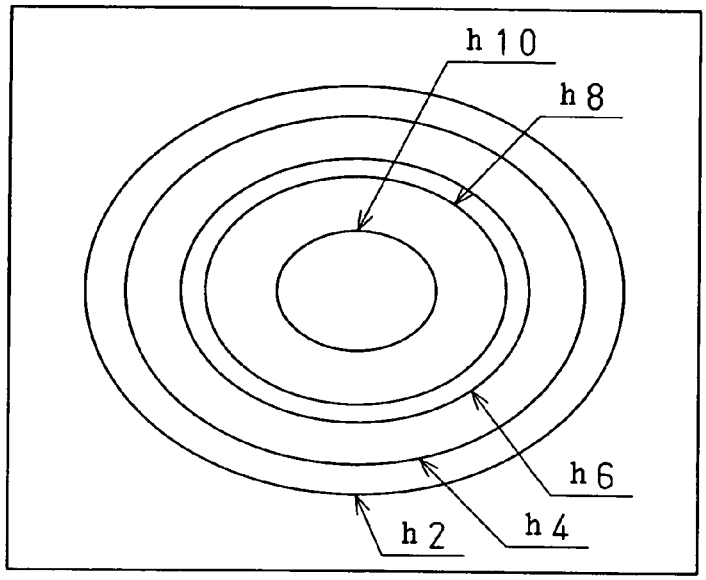
FIGS. 17A and 17B are diagrams showing the shape of a projection formed on the outer surface of the cylinder liner in each embodiment.

The measurement of the contour lines of each projection 8 will now be described with reference to FIG. 17. A test piece for contour line measurement is set on a testing platform with the bottom surface 8*e* (liner outer surfaces 6 and 106) facing toward the non-contact type three-dimensional laser measuring device. A laser beam is irradiated so as to be substantially orthogonal to the liner outer surfaces 6 and 106. The measurement result is retrieved by an image processing device to generate the contour map of the projection 8 as shown in FIG. 17A.

Figure 17B:
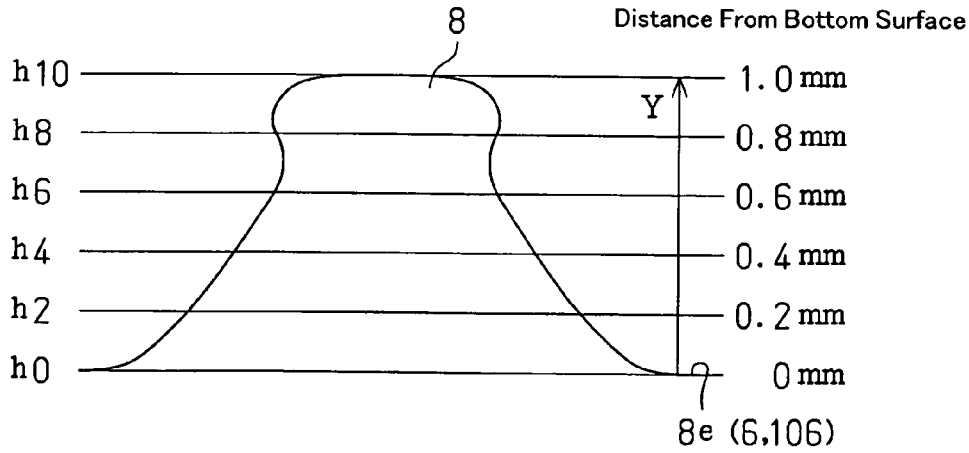

FIG. 17B shows the relationship between the liner outer surface 6 and 106 and contour lines h. The contour lines h for a projection 8 are taken at every predetermined distance in the height direction (direction of arrow Y) from the liner outer surfaces 6 and 106. The distance in the direction of the arrow Y using the liner outer surfaces 6 and 106 as a reference is hereinafter referred to as the "measuring height". In the contour maps of FIGS. 17A and 17B, the contour lines h are shown for intervals of 0.2 mm. However, the intervals of the contour lines h may be changed.

[a] First Projection Area Ratio S1

Figure 18A:
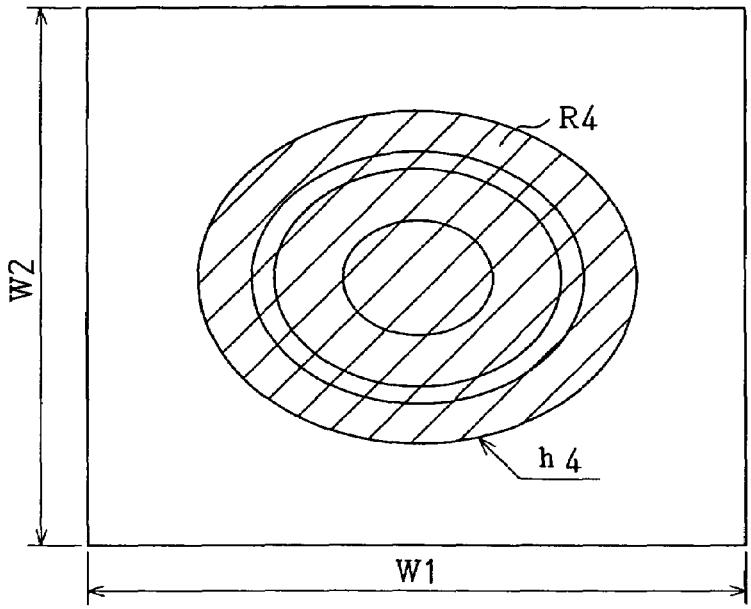
FIGS. 18A and 18B are contour maps showing the shape of the projection formed on the outer surface of the cylinder liner in each embodiment.

FIG. 18A is a contour map (first contour map) only showing contour lines h for the measuring height of 0.4 mm or higher. The area of the contour map (W1×W2) is the unit area for obtaining the first projection area ratio S1. In the first contour map, the area of the region R4 surrounded by contour line h4 (area SR4 indicated by the hatching lines in the drawing) is equivalent to the cross-sectional area of a projection at a plane lying along measuring height 0.4 mm (first projection cross-sectional area). The number of regions R4 (region quantity N4) in the first contour map corresponds to the number of projections 8 (projection number N1) in the first contour map.

The first projection area ratio S1 is calculated as the ratio of the total area of the region R4 (SR4×N4) occupying the area (W1×W2) of the contour map. That is, the first projection area ratio S1 corresponds to the total first cross-sectional area of the projection occupying a unit area in the plane at measuring height 0.4 mm. The first projection area ratio S1 is obtained from the formula shown below.

$$S1=(SR4\times N4)/(W1\times W2)\times 100[\%]$$

[b] Second Projection Area Ratio S2

Figure 18B:
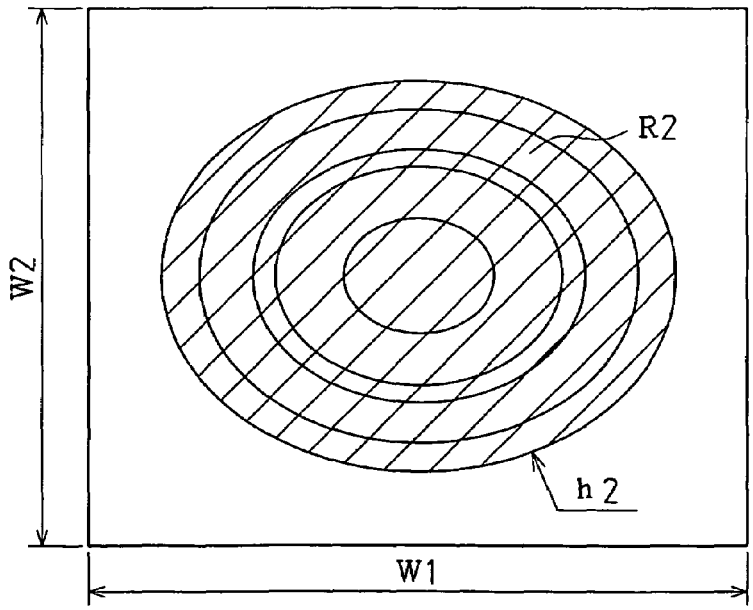

FIG. 18B shows the contour map (second contour map) only showing contour lines h for the measuring height of 0.2 mm or higher. The area of the contour map (W1×W2) is the unit area for obtaining the second projection area ratio S2. In the second contour map, the area of the region R2 surrounded by the contour line h2 (area SR2 indicated by the hatching lines in the drawing) is equivalent to the cross-sectional area of a projection (second projection cross-sectional area) at a plane lying along the measuring height 0.2 mm. The number of regions R2 (region quantity N2) in the second contour map corresponds to the number of projections 8 in the second contour map. The area of the second contour map is equal to the area of the first contour map. Thus, the number of the projections 8 is equal to the projection number N1.

The second projection area ratio S2 is calculated as the ratio of the total area of the region R2 (SR2×N2) occupying the area (W1×W2) of the contour map. That is, the second projection area ratio S2 corresponds to the total second cross-sectional area of the projection 8 occupying a unit area of the liner outer surface 16 along the plane at measuring height 0.2 mm. The second projection area ratio S2 is obtained from the formula shown below.

$$S2=(SR2\times N2)/(W1\times W2)\times 100[\%]$$

[c] First and Second Projection Cross-Sectional Areas

The first projection cross-sectional area is calculated as the cross-sectional area of a projection taken along the plane at measuring height 0.4 mm, and the second projection cross-sectional area SR2 is calculated as the cross-sectional area of a projection taken along the plane at measuring height 0.2 mm. For example, image processing is performed with the contour map, the first projection cross-sectional area is obtained by calculating the area of the region R4 in the first contour map (FIG. 18A), and the second projection cross-sectional area is obtained by calculating the area of the region R2 in the second contour map (FIG. 18B).

[d] Projection Number

The projection number N1 is the number of projections 8 that are formed per unit area (1 $cm^2$) of the liner outer surfaces 6 and 106. For example, image processing is performed with the contour map, and the projection number N1 is obtained by calculating the number of regions R4 (region quantity N4) in the first contour map (FIG. 18A).

A cylinder liner having a first area ratio of 10% or greater was compared with a cylinder liner having a first area ratio of less than 10% with regard to the deformation amount of a bore in a cylinder block. As a result, the deformation amount of the cylinder bore of the latter cylinder liner was found to be three times greater than that of the former cylinder bore. The gap percentage suddenly increases when a cylinder liner has a second projection area ratio S2 of 55% or greater. The gap percentage is the percentage of gaps occupying the cross-section at the boundary between the cylinder liner and the cylinder block. Based on these results, the bonding strength and adhesion of the block material and the cylinder liner are increased by applying the cylinder liner having the first projection area ratio S1 of 10% or greater and the second projection area ratio S2 of 55% or less to the cylinder block. The second projection area ratio S2 becomes 55% or less when the upper limit of the first projection area ratio S1 is 50%. The first projection area ratio S1 becomes 10% or greater when the lower limit of the second projection area ratio S2 is 20%.

[Further Embodiments]

(1) In the contour maps shown in FIGS. 17A to 18B, the projections 8 may be formed so that the region R4 surrounded by the contour line h4 is shown for each projection 8. That is, the cylinder liner may be formed so that each projection 8 is independent at the position of measuring height 0.4 mm. In this case, the bonding force between the cylinder block and the cylinder liner is further enhanced. Further, at the position of measuring height of 0.4 mm, damage of the projection 8 and decrease in the bonding force are suppressed during manufacturing by setting the area per projection 8 to 0.2 $mm^2$ to 3.0 $mm^2$.

(2) In the roughening process of the first embodiment, the roughening is performed on only the upper region 6*a*. However, a strong roughening process may be performed on the upper region 6*a* and a weak roughening process may be performed on the lower region 6*b* so as to adjust the difference in adhesion and thermal conductivity between the upper region 6*a* and the lower region 6*b*.

(3) In the second and third embodiments, the fume deposit layer 114 is formed only on the lower region 106*b*. However, a fume deposit layer thinner than the lower region 106*b* may be formed on the upper region 106*a* so as to adjust the difference in adhesion and thermal conductivity between the upper region 106*a* and the lower region 106*b*.

(4) In each of the above embodiments, the sprayed layers 10 and 116 are formed on the liner outer surfaces 6 and 106 of the cylinder liner main bodies 2*a* and 102*a*. However, the sprayed layers 10 and 116 may be omitted. More specifically, in the first embodiment, the cylinder liner main body 2*a* of which only the upper region 6*a* undergoes the roughening process in step G may be used as the cylinder liner that is insert cast in the cylinder block. This also produces a difference in thermal conductivity states dues to the difference in adhesion to the cylinder block at the upper region 106*a* and the lower region 106*b*. Further, since the bonding strength to the cylinder block is sufficiently large due to the projections 8, the same advantages as the above embodiments are obtained.

(5) In the first embodiment, the roughening is divided into two levels in the direction of the axis L of the cylinder liner main body 2*a*. However, the roughening may be divided into three or more stages. For example, three regions may be defined, an upper region, a middle region, and a lower region. The level of roughening is gradually be decreased from the upper region toward the lower region. In this case, the roughening process does not have to be performed at all on the lower region. Further, in the second and third embodiments, the fume deposition is divided into two levels in the direction of the axis L. However, the fume deposition may be divided into three or more stages. For example, three regions may be defined, an upper region, a middle region, and a lower region. The thickness of the fume deposition is gradually decreased from the upper region toward the lower region. In this case, the fumes do not have to be deposited at all on the lower region.

(6) In each of the above embodiments, the projections in satisfy all of the following conditions (a) to (d):

(a) the projections have a height of 0.5 mm to 1.5 mm;

(b) the projections on the outer surface are in a quantity of 5 to 60 per $cm^2$;

(c) in the contour map of the projections obtained by measuring the liner outer surface in the height direction of the projections with the three-dimensional laser measuring device, the area ratio S1 of the region surrounded by the contour line at height 0.4 mm is 10% or greater; and (d) in the contour map of the projections obtained by measuring the liner outer surface in the height direction of the projections with the three-dimensional laser measuring device, the area ratio S2 of the region surrounded by the contour line at height 0.2 mm is 55% or less.

Alternatively, the projections may satisfy all of the following conditions (a) to (d):

(a) the height of the projections is 0.5 mm to 1.5 mm;

(b) the quantity of the projections on the liner outer surface is 5 to 60 per $cm^2$;

(c) in the contour map of the projections obtained by measuring the liner outer surface in the height direction of the projections with the three-dimensional laser measuring device, the area ratio S1 of the region surrounded by the contour line at height 0.4 mm is 10% to 50%; and (d) in the contour map of the projections obtained by measuring the liner outer surface in the height direction of the projections with the three-dimensional laser measuring device, the area ratio S2 of the region surrounded by the contour line at height 0.2 mm is 20% to 55%.

Further, the projections only need to satisfy either one of the following conditions (a) and (b):

(a) the height of the projections is 0.5 mm to 1.5 mm;

(b) the quantity of the projections on the liner outer surface is 5 to 60 per $cm^2$.

In such a case, a strong bonding force is also obtained between the cylinder liner and the cylinder block.

The projection may satisfy at least one of conditions (a) and (b) in addition to conditions (c) and (d). In this case, a strong bonding force is also obtained between the cylinder liner and the cylinder block. Further, as long as a plurality of bottleneck-shaped projections project from the outer surface, the bonding force to the cylinder block is sufficient and greater than that of the prior art even if the above conditions are not satisfied.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

The invention claimed is:

1. A cylinder liner for bonding with a predetermined adhesiveness to a cylinder block of an internal combustion engine when casting the cylinder block, the cylinder liner comprising:

an outer surface insert cast in casting metal directly or via an intermediate layer; and a plurality of bottleneck-shaped projections arranged on the outer surface;

wherein the adhesiveness between the outer surface and the cylinder block or the intermediate layer differs along an axial direction of the cylinder liner, wherein the cylinder liner has an upper portion and a lower portion, the upper portion solely undergoes a roughening process so that the adhesiveness at the upper portion is greater than the adhesiveness at the lower portion.

2. The cylinder liner according to claim 1, wherein the projections satisfy at least one of the following conditions:

(a) the projections have a height of 0.5 mm to 1.5 mm; and (b) the projections on the outer surface are in a quantity of 5 to 60 per $cm^2$.

3. The cylinder liner according to claim 2, wherein the projections further satisfy both of the following conditions:

(c) in a contour map of the projections obtained by measuring the outer surface in the height direction of the projections, an area ratio S1 of a region surrounded by a contour line for a height of 0.4 mm is 10% or greater; and (d) in a contour map of the projections obtained by measuring the outer surface in the height direction of the projections, an area ratio S2 of a region surrounded by a contour line for a height of 0.2 mm is 55% or less.

4. The cylinder liner according to claim 2, wherein the projections further satisfy both of the following conditions:

(c) in a contour map of the projections obtained by measuring the outer surface in the height direction of the projections, an area ratio S1 of a region surrounded by a contour line for a height of 0.4 mm is 10% to 50%; and (d) in a contour map of the projections obtained by measuring the outer surface in the height direction of the projections, an area ratio S2 of a region surrounded by a contour line for a height of 0.2 mm is 20% to 55%.

5. The cylinder liner according to claim 1, wherein the intermediate layer is sprayed to an upper portion and a lower portion of the outer surface.

6. The cylinder liner according to claim 3, wherein the projections further satisfy both of the following conditions:

(e) the regions surrounded by the contour line for the height of 0.4 mm are independent from each other in the contour map; and (f) the area of the regions surrounded by the contour line for the height of 0.4 mm is 0.2 $mm^2$ to 3.0 $mm^2$ in the contour map.

7. The cylinder liner according to claim 1, wherein the roughening process is performed by carrying out a shot blast treatment or a water jet treatment.

8. A cylinder liner for bonding with a predetermined adhesiveness to a cylinder block of an internal combustion engine when casting the cylinder block, the cylinder liner comprising:

an outer surface insert cast in casting metal directly or via an intermediate layer; and a plurality of bottleneck-shaped projections arranged on the outer surface, wherein the adhesiveness between the outer surface and the cylinder block or the intermediate layer differs along an axial direction of the cylinder liner, wherein the cylinder liner has an upper portion and a lower portion, with the adhesiveness of the lower portion being less than the adhesiveness of the upper portion, and wherein a substance hindering the adhesiveness between the outer surface and the cylinder block or intermediate layer is deposited in a greater amount on the lower portion of the outer surface than the upper portion of the outer surface.

9. A cylinder liner for bonding with a predetermined adhesiveness to a cylinder block of an internal combustion engine when casting the cylinder block, the cylinder liner comprising:

an outer surface insert cast in casting metal directly or via an intermediate layer; and a plurality of bottleneck-shaped projections arranged on the outer surface, wherein the adhesiveness between the outer surface and the cylinder block or the intermediate layer differs along an axial direction of the cylinder liner, wherein the cylinder liner has an upper portion and a lower portion, with the adhesiveness of the lower portion being less than the adhesiveness of the upper portion, and wherein a substance hindering the adhesiveness between the outer surface and the cylinder block or intermediate layer is deposited only on the lower portion of the outer surface.

10. The cylinder liner according to claim 8, wherein the substance hindering the adhesiveness is from fumes produced when spraying is performed.

11. The cylinder liner according to claim 10, wherein a sprayed layer is formed as the intermediate layer on fumes deposited on the outer surface.

12. A cast cylinder block for an internal combustion engine, the cylinder block comprising:

a casting metal of light alloy material;

a cylinder liner insert cast in the casting metal and bonded with a predetermined adhesiveness to the cylinder block when casting the cylinder block, the cylinder liner including:

an outer surface insert cast in the casting metal directly or via an intermediate layer; and a plurality of bottleneck-shaped projections arranged on the outer surface;

wherein the adhesiveness between the outer surface and the cylinder block or the intermediate layer differs along an axial direction of the cylinder liner, wherein the cylinder liner has an upper portion and a lower portion, the upper portion solely undergoes a roughening process so that the adhesiveness at the upper portion is greater than the adhesiveness at the lower portion.

* * * * *